US005604401A

United States Patent [19]

Makishima

[11] Patent Number: 5,604,401

[45] Date of Patent: Feb. 18, 1997

[54] FIELD-EMISSION COLD CATHODE FOR DUAL-MODE OPERATION USEABLE IN A MICROWAVE TUBE

[75] Inventor: Hideo Makishima, Tokyo, Japan

[73] Assignee: NEC Corporation, Tokyo, Japan

[21] Appl. No.: 361,535

[22] Filed: Dec. 22, 1994

[30] Foreign Application Priority Data

Dec. 22, 1993 [JP] Japan ..... 5-323580

[51] Int. Cl.[6] ..... H01J 23/04

[52] U.S. Cl. ..... 315/3; 315/5.33; 313/309; 313/351

[58] Field of Search ..... 315/5.29, 5.33, 315/5.37, 3; 313/309, 351

[56] References Cited

U.S. PATENT DOCUMENTS

| | | | |
|---|---|---|---|
| 4,145,635 | 3/1979 | Tuck | 313/309 X |
| 4,163,918 | 8/1979 | Shelton | 313/309 |
| 5,124,664 | 6/1992 | Cade et al. | 313/309 X |

FOREIGN PATENT DOCUMENTS

| | | |
|---|---|---|
| 1-60340 | 4/1989 | Japan . |
| 3-52168 | 8/1991 | Japan . |
| 4-36748 | 3/1992 | Japan . |

*Primary Examiner*—Benny T. Lee
*Attorney, Agent, or Firm*—Young & Thompson

[57] ABSTRACT

An electron beam having a high current ratio between the high and the low current modes, susceptible to no significant change in beam diameter and relatively free from ripples in both modes is formed. This electron beam is used to realize a highly reliable, simple-structured and compact microwave tube which performs nearly optimal RF operations in both modes. The gate electrode or the emitter electrode, in which emitters are formed, of a field-emission cold cathode is divided into a plurality of parts, and the area in which electrons are emitted is switched over by varying the voltage applied to this divided electrode to make possible switching between two current modes, the high and the low. Alternatively, the current ratio between the high and the low current modes is made settable by making variable the connections between three or more parts into which the gate electrode or the emitter electrode are divided.

15 Claims, 6 Drawing Sheets

FIELD-EMISSION COLD CATHODE FOR DUAL-MODE OPERATION USEABLE IN A MICROWAVE TUBE

BACKGROUND OF THE INVENTION

1. Field of the Invention

The present invention relates to a field-emission cold cathode which emits electrons from sharp tips, a microwave tube using it, and more particularly to such a microwave robe for use in dual-mode pulse operation.

2. Description of Related Art

A microwave robe, such as a travelling-wave robe, a klystron, a gyrotron or the like, may be used in pulse operation turn its output on and off, and further may be used in dual-mode pulse operation which the output of the microwave tube has two values while it is on. Therefore, according to the prior art, a plurality of grids are provided in front of the cathode to control the current quantity emitted from the hot cathode.

As a first example of the prior art, the structure of an electron gun disclose, in Japanese Utility Model Laid-Open No. 60340 of 1989 is shown in FIG. 1. The electron gun 101 has a first grid (shadow grid) 103 and second grid (control grid) 104, both spherically shaped, close to a similarly spherical cathode 102, and an electron beam from the cathode 102, heated by a heater 105, pass through aligned beam transmission holes 110 and 111 of the two grids 103 and 104, respectively, and are electro-statically focused by a focusing electrode 106 and an anode 107. To prevent the electron beam from colliding with the second grid 104, a pulse voltage of hundreds of volts is applied on the second grid 104, and the electron beam synchronized with this pulse voltage is taken out of the cathode 102.

As a second example of the prior art, another electron gun structure disclosed in the U.S. Pat. No. 4,593,130 and the Japanese Patent Laid-Open No. 176851 of 1983 is illustrated in FIG. 2. The electron gun 101 has a first grid 103 and a second grid 104, both spherically shaped, close to a similarly spherical cathode 102, and an electron beam from the cathode 102, heated by a heater 105, and are electro-statically focused by a focusing electrode 106 and an anode 107. This electron gun permits turning on and off in a pulsed manner two modes of current quantity, a high current mode and a low current mode, and the pulse output of a microwave tube using this electron gun can be varied according to the current mode. In a first grid 103, the central part is coarse and the peripheral part is free, while in a second grid 104, the central part is as coarse as that of the first grid 103 and the peripheral part is even coarser. The second grid 104 is always applied with 250 V against the cathode. When in the high current mode, the first grid 103 is biased to +36 V, and electrons are emitted from all over the cathode. When in the low current mode, the first grid 103 is biased to −36 V, and electrons are emitted from only the central part of the cathode, i.e. the coarse part of the first grid 103. At this time, as the potential of the first grid 103 is lower than that in the high current mode, the density of the current emitted From the central part also decreases, and so does the total current. In FIG. 2, a reference lable "+" indicates a plus voltage source and a reference lable "±" indicates a plus or minus voltage source.

As a third example of the prior art, still another electron gun structure disclosed in Japanese Patent Gazette No. 52168 of 1991 is illustrated in FIG. 3, and as a fourth example, yet another electron gun structure disclosed in Japanese Utility Model Laid-Open No. 36748 of 1992 is shown in FIG. 4. As seen in FIGS. 3 and 4, the electron gun 101 has a first grid 103, a second grid 104 and from the cathode 102 are electro-statically focused by a focusing electrode 106 and an anode 107. In both the third and fourth examples of the prior art, the electron beam is controlled by three grids, the current being emitted from-all over the cathode when in the high current mode, and from only the central pan of the cathode when in the low current mode.

In the examples of the prior art illustrated in FIGS. 1, 2, 3 and 4, the two grids 103 and 104, or three grids, have to be fixed at high accuracy immediately in front of the cathode 102 whose temperature is as high as 700° C. to 1000° C. Especially in the example shown in FIG. 1, the transmission holes 110 and 111 of the two grids 103 and 104 should be precisely aligned, which means sophisticated labor skills and a long time required for assembly.

In the example of the prior an illustrated in FIG. 1, the voltage of the second grid 104 should be different between the high current mode and the low current mode, but changing this voltage results in a substantial change in the focusing condition of the electron beam, making it impossible to maintain the optimal focusing condition for both the high current and the low current modes. As a consequence, the current ratio between the two modes cannot be raised beyond a certain limit, making it extremely difficult to optimize RF characteristics, such as the efficiency of conversion between DC power and RF power, in both modes.

In the example of the prior art shown in FIG. 2, while the focusing condition of the electron beam does not substantially vary with a change in voltage because, between the two modes, the emitting current instead of the voltage of the first grid 103 is changed but not the voltage of the second grid 104, but the focusing condition is still greatly varied by a change in emitting cathode area. Since the average diameter of the electron beam in the region where the electron beam interacts with RF signals is substantially proportional to the diameter of the cathode, the average diameter of the electron beam is smaller in the low current mode than in the high current mode, with the result that the focusing condition of the electron beam differs between the two modes, and so does, substantially, the amplification gain. In the low current mode, as the diameter of the electron beam decreases to give some clearance between this diameter and the bore of a spiral delay circuit, the current ratio between the two modes can be increased by optimizing the electron beam focusing magnetic field for the current in the high current mode and allowing some ripples for the electron beam in the low current mode, but it still is impossible to optimize the operating condition for both modes.

Moreover, whereas it is necessary to change the first or second grid voltage in order to vary the current ratio between the two modes, this might change the focusing condition and, accordingly, the electron beam transmitting characteristic and the like.

SUMMARY OF THE INVENTION

According to the present invention, switching between two current modes, high and low, can be made possible by dividing the electrode or the emitter electrode, where an emitter is formed, of a field-emission cold cathode into a plurality of pans, varying the voltage fed to this electrode and thereby switching the area from which electrons are emitted.

Furthermore, it is made possible to switch between the high and low current modes by switching the pulse voltage between the gate electrode and the emitter electrode.

Also, the invention makes it possible to alter the current ratio between the high and the low current modes by making variable the connections between the three or more parts into which the gate electrode or the emitter electrode are divided. This field-emission cold cathode is used to form a microwave tube which permits switching the output power between two levels.

As a result, the simplified structure of the electron gun section serves to reduce the time required for assembly, and makes it possible to realize a compact and high-precision electron gun. As the focusing conditions of the electron beam are substantially the same between the high and the low current modes, the adjustment of the electron beam focusing section, consisting of a magnet or the like, simplified, and it is made possible to set both modes in nearly optimal conditions, to reduce the current flowing in the slow wave circuit, such as a spiral currant, and to improve the reliability and efficiency of the electron tube. As a result, the KF characteristic can also be set in a nearly optimal condition in both modes.

Furthermore, since it is possible to vary the current ratio between the high and the low current modes with the connecting conditions of external circuits, the product can be flexibly adapted to many different uses.

Thus, the present invention makes it possible to realize an electronic device, more particularly a microwave tube, simultaneously having many advantages which cannot be realized by any aspect of the already disclosed prior art or by merely replacing a hot cathode with a cold cathode.

BRIEF DESCRIPTION OF THE DRAWINGS

The above and other objects, features and advantages of the present invention will become more apparent from the following detailed description when taken in conjunction with the accompanying drawings, wherein:

FIGS. 5A, 5B illustrate the structure of a cold cathode, which is a first preferred embodiment of the invention, in which FIG. 5A shows a cross-sectional view and FIG. 5B is a plan view showing the pattern of the emitter electrode thereof;

DESCRIPTION OF THE PREFERRED EMBODIMENTS

Figure 1:
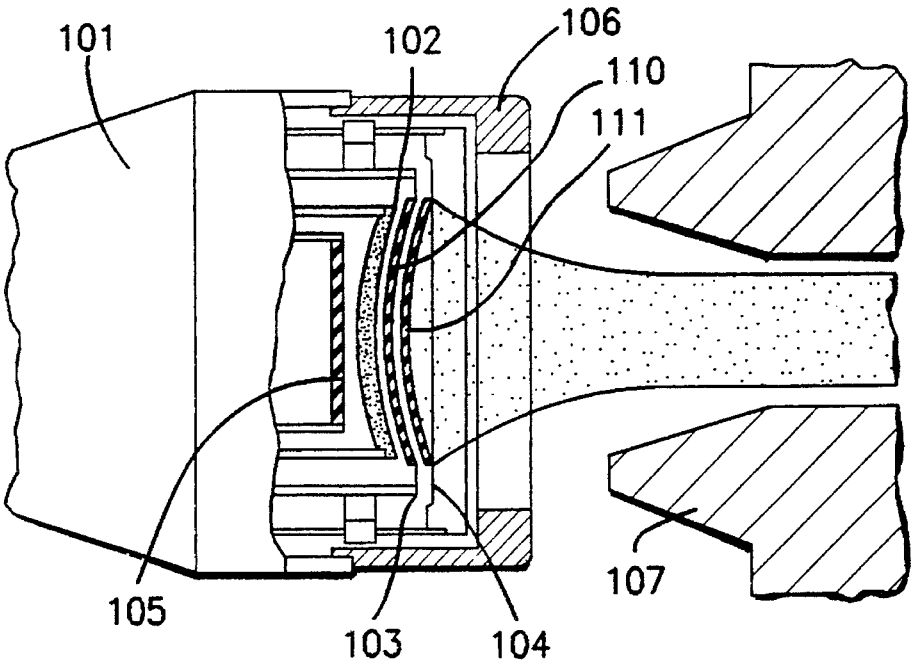
FIG. 1 PRIOR ART
FIG. 1 is a cross-sectional view illustrating the structure of an example of electron gun according to the prior art.
Figure 2:
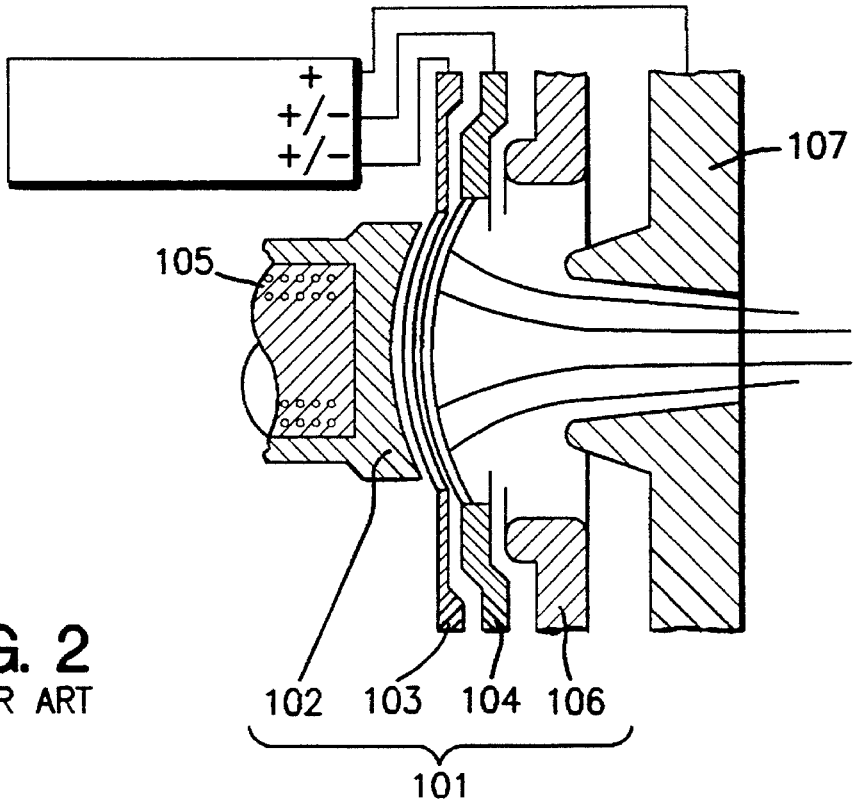
FIG. 2 PRIOR ART
FIG. 2 is a cross-sectional view illustrating the structure of another example of electron gun according to the prior art.
Figure 3:
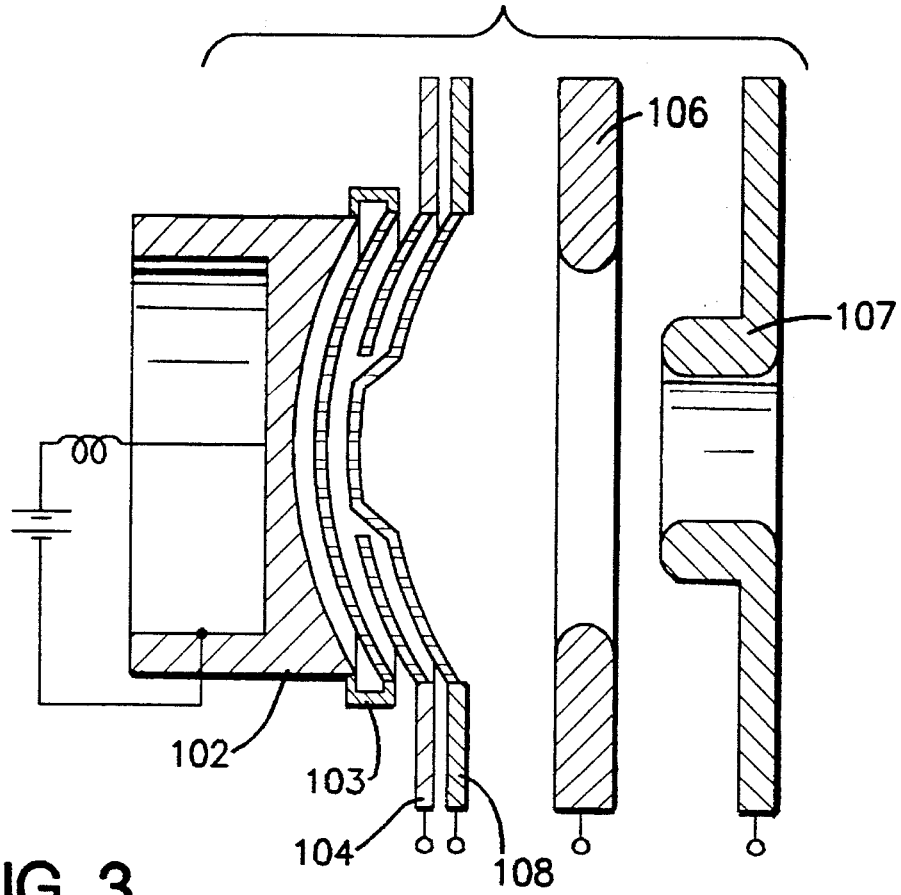
FIG. 3 PRIOR ART
FIG. 3 is a cross-sectional view illustrating the structure of still another example of electron gun according to the prior art.
Figure 4:
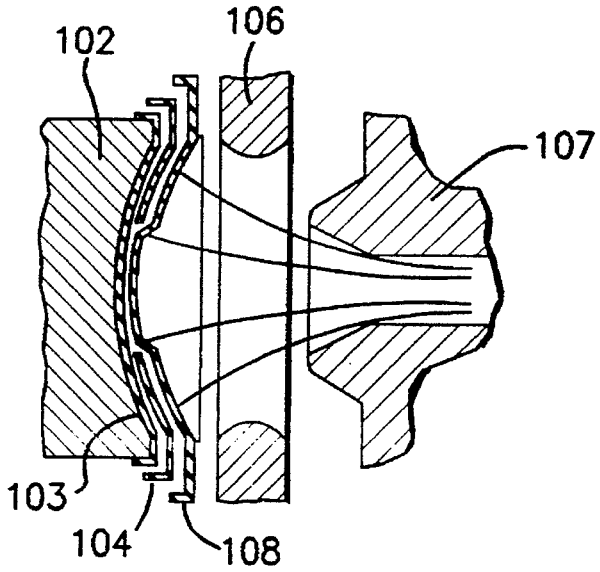
FIG. 4 PRIOR ART
FIG. 4 is a cross-sectional view illustrating the structure of yet another example of electron gun according to the prior art.
Figure 5A:
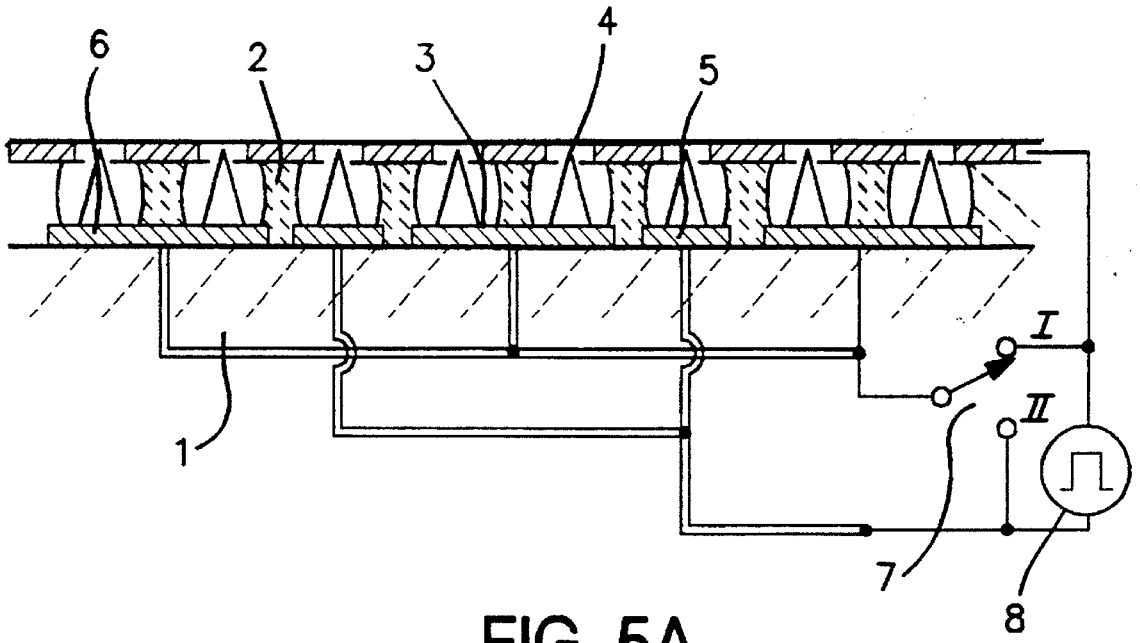
Figure 5B:
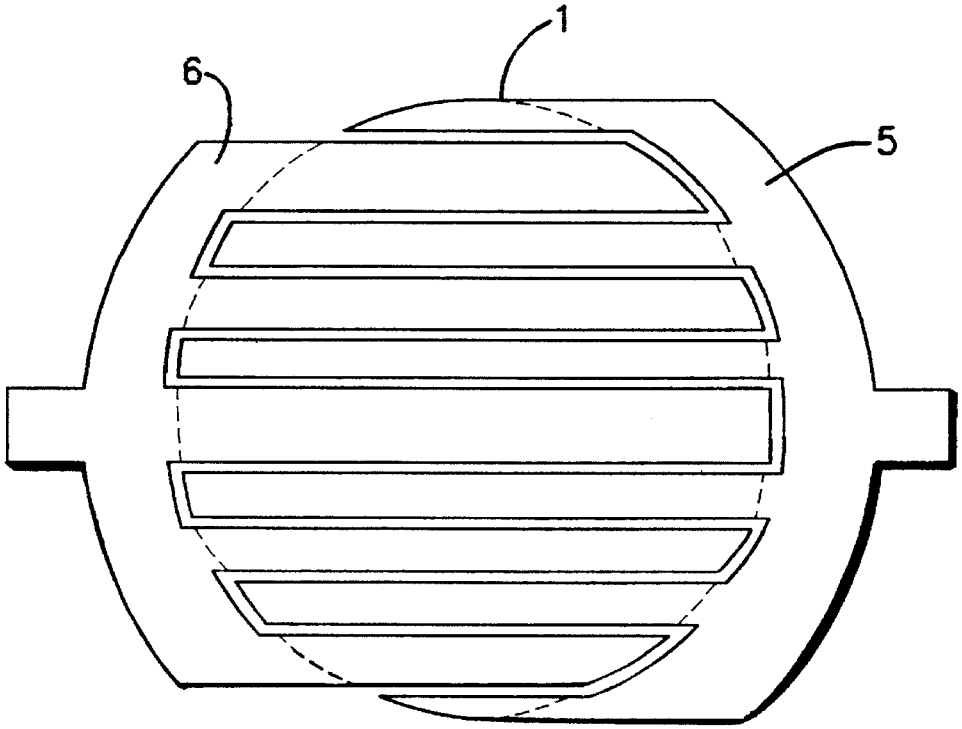

Referring to FIG. 5A and FIG. 5B, over an insulating substrate 1 are formed in the pattern illustrated in FIG. 5B a first emitter electrode 5 and a second emitter electrode 6, each consisting of a metal film. Thus, the first emitter electrode 5 and the second emitter electrode 6 are so formed as to cover the circular electron emitting area, represented by the broken line, in an interfingered manner. Is seen in FIG. 5A, emitter electrodes 5, 6 are formed many minute conical emitters 4 and, except around the emitters 4, an insulating layer 2 is formed contacting substrate 1 and emitter electrodes 5, 6. The insulating layer 2 surrounds but does not contact the emitters 4. Over the insulating layer 2 is formed, at substantially the same height as the tips of the emitters 4, a gate electrode 3 having circular openings surrounding each emitter 4. The height of the emitters 4 and the thickness of the insulating layer 2 are about 1 μm; the diameter of the openings of the gate electrode 3 is about 1.5 μm; and the intervals between the emitters 4 range from 5 to 10 μm. The overall diameter of the electron emitting section, varying with the use of the cold cathode, is typically from 1 to 4 min.

In order to obtain emission from this cold cathode, a voltage of about 100 V is applied to the gate electrode 3 against the emitters 4 to form a very high electric field at the pointed tip of each emitter 4. Although the emitted current per emitter is only 0.1 to 10 μm, a sufficient total current for operation as a microwave robe can be obtained because many emitters can be formed if the emitters are spaced at 5 to 10 μm intervals. As seen in FIG. 5A, in order to take out the current in a pulsed manner, a pulse power source 8 can be connected between the emitters 4 and the gate electrode 3 to apply a pulse voltage of about 100 V. If a switch 7 is set in the position II, the cold cathode will take on a high current mode. At this time, an electric field is applied to the tip of every emitter, and electrons are emitted from all over the cathode, i.e. the emitters all over the circular electron emitting area represented by the broken line. If the switch 7 is set in position I, the cold cathode will take on a low current mode. At this time, since the second emitter electrode 6 is always kept at the same potential as the gate electrode 3, no electrons are emitted from those emitters 4 which are formed over the second emitter electrode 6, but rather electrons are emitted only from the other emitters 4 formed on the first emitter electrode 5.

Thus, as the number of emitters from which electrons are emitted is varied by actuating the switch 7, the emitted current also varies proportionally. At this time, irrespective of the position of the switch 7, i.e. of the emitted current, the potentials of the emitters 4 emitting electrons, the gate electrode 3 and other electrodes (not shown) than the cathode are always kept in respectively the same conditions. As a result, since the focusing condition of the electron beam is always kept the same except for the beam current value, i.e. the space-charge effect, whether in the high or the low current mode, focusing is kept substantially constant.

In an electron beam focusing system having parameters of, for instance, 100 mA (in the high current mode) or 10 mA (in the low current mode) in beam current, 400 V in beam voltage, 30 Gauss in cathode magnet field, 2500 Gauss in peak value of periodic magnetic field, and 8 mm in pitch of period magnetic field, the average diameters of the electron beam emitted from a cathode of 2 mm in radius are about the same in the high and low current modes, 0.24 mm and 0.22 mm, respectively. On the other hand, if the cathode radius in the low current mode were reduced to achieve the same cathode current density as in the high current mode, the average diameter of the electron beam would substantially change to 0.8 mm. In this case, the gain in the low current mode would drop, and ripples might occur in the electron beam on account of mismatching between the electron gun section and the periodic magnetic field section.

Incidentally, the pattern shown in FIG. 5B only schematically represents an example of the division of emitter electrodes 5 and 6, but in practice they can be much more finely divided than illustrated in FIG. 5B to achieve more uniform distribution of the cathode-emitted current in the low current mode.

Figure 6:
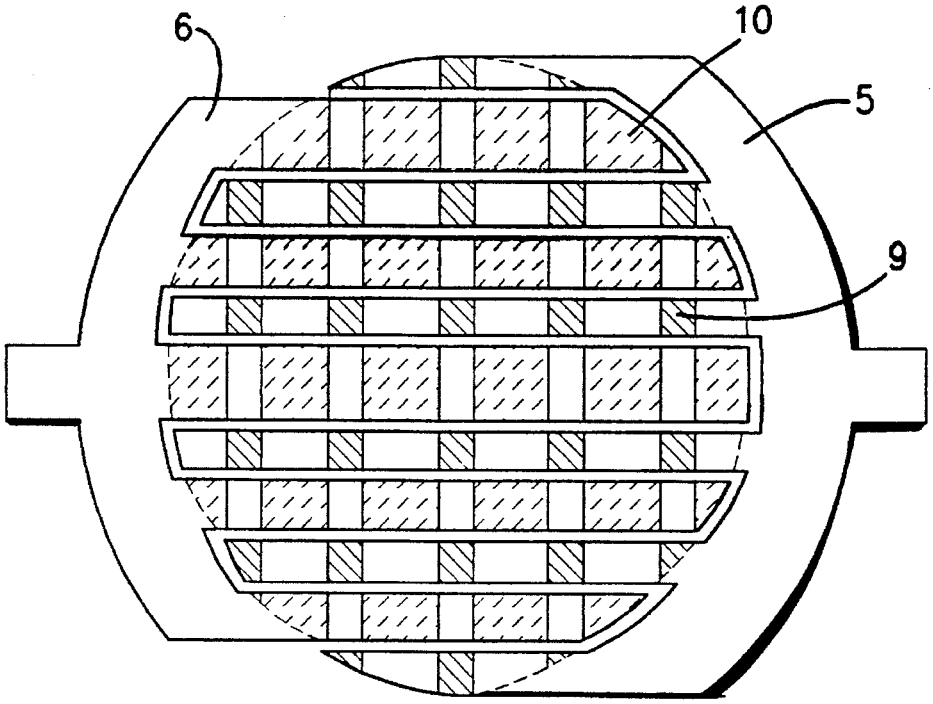
FIG. 6 is a plan view illustrating the emitter electrode pattern of a cold cathode according to a second preferred embodiment of the invention.

Referring to FIG. 6 (second embodiment), in the parts marked with diagonal lines (the emission area) are formed a required number of emitters on emitter electrodes 5, 6, and the insulating layer and the gate electrode are formed as in the first preferred embodiment to constitute a cold cathode. By arranging a pattern to form the emitters 4 on the first emitter electrode 5 and the second emitter electrode 6 as shown in FIG. 6, the axial symmetry of the distribution of electron emitting current density can be improved both in the low and the high current modes. In FIG. 6, reference numeral 9 denotes a first emission area formed in the first emitter electrode 5, and in this pan are formed emitters. Similarly, reference numeral 10 denotes a second emission area formed in the second emitter electrode 6, and in this part are formed emitters. Electrons are emitted, in the low current mode, from only the emitters in first emission areas 9 and, in the high current mode, from emitters of both the first emission area 9 and the second emission area 10. This configuration provides a distribution of emitting current density with a satisfactory level of axial symmetry both in the low and the high current modes.

It will be appreciated that the use of a pattern in which the first emitter electrode 5 and the second emitter electrode 6 are inter-digitated without linearly contacting each other, permits obtaining a distribution of emitting current density with a satisfactory level of axial symmetry without sacrificing the emission area.

Alternatively, by varying the number and spacing of emitters 4 in the direction of the fingers of the emitter electrodes and a direction normal to it, without forming specified emission areas as illustrated in FIG. 5A, 5B a similar effect can also be achieved to provide a distribution of emitting current density with a satisfactory level of axial symmetry. Furthermore, a similar effect can also be achieved by configuring the first emitter electrode 5 and the second emitter electrode 6 as two interfitting spirals.

Figure 7:
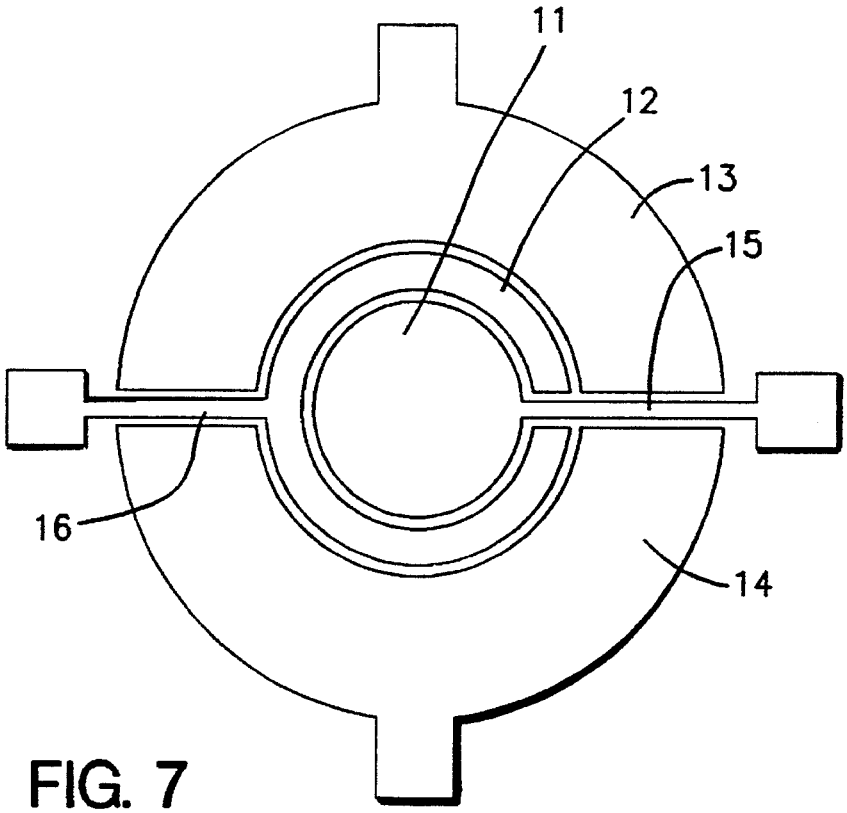
FIG. 7 is a plan view illustrating the emitter electrode pattern of a cold cathode according to a third preferred embodiment of the invention.

In the third embodiment as shown in FIG. 7, the emitter electrode section is divided into three coaxial electrodes, of which the innermost is a first emitter electrode 11, the middle is a second emitter electrode 12, and the outermost is divided by the wires 15 and 16 of the first emitter electrode 11 and the second emitter electrode 12, respectively, to constitute a third emitter electrode 13 and a fourth emitter electrode 14. Over each emitter electrode are formed a required number of emitters 4 (not shown), and the insulating layer 2 (not shown) and the gate electrode 3 (not shown) are formed as in the first preferred embodiment to constitute a cold cathode.

To actuate the cold cathode into which the emitter electrodes illustrated in FIG. 7 are built, a DC or pulse voltage is continuously applied to the first emitter electrode 11, the third emitter electrode 13 and the fourth emitter electrode 14 are normally kept connected to each other, and a voltage equal or close to that of the gate electrode 3 is applied to them when in the low current mode. When in the high current mode, a voltage equal to that of the first emitter electrode 11 is applied. The second emitter electrode 12, according to the designed current ratio between the low and the high current modes, is connected to the first emitter electrode to increase the current in the low and the high current modes, or connected to the third and fourth emitter electrodes to increase the current in the high current mode, or connected to the gate electrode 3 to keep the current from being emitted. The choice among these three alternatives can be made by correspondingly connecting the exterior of the cold cathode. Thus, the inside of the electron tube case and the outside of the same can be connected on the cold cathode substrate, inside the vacuum outer holder or outside the vacuum outer holder.

In the first through third embodiments, a substrate having an insulating layer formed over an electro-conductive substrate or a semiconductor substrate may be used in place of the insulating substrate 1.

Figure 8:
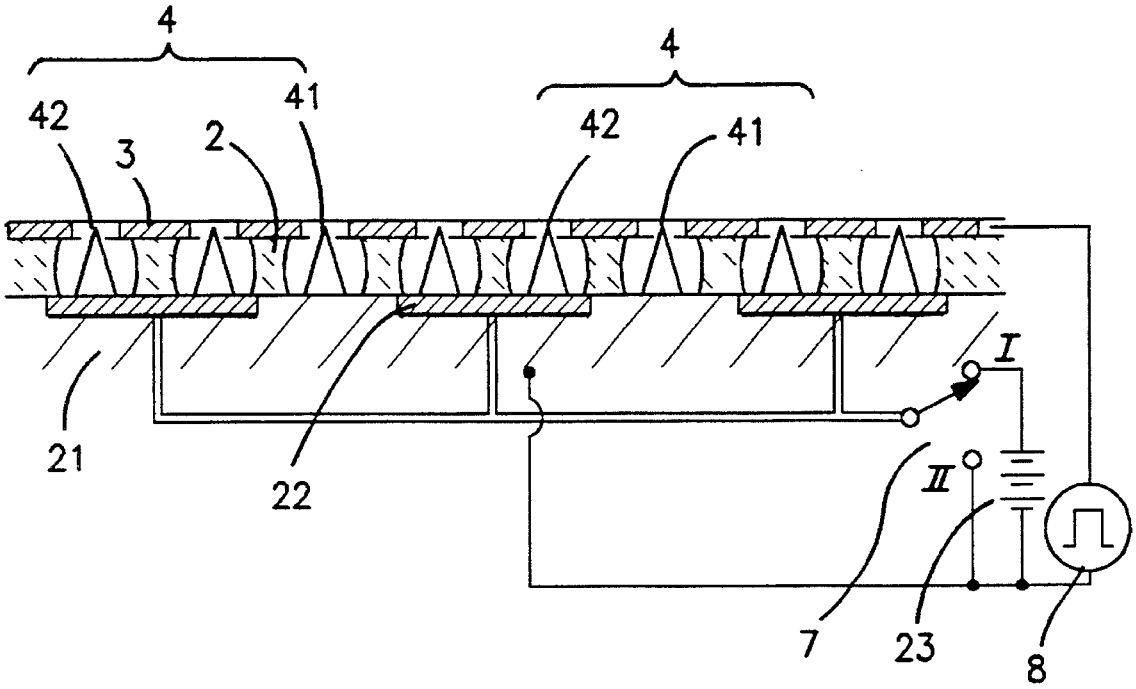
FIG. 8 shows a cross-sectional view of a cold cathode according to a fourth preferred embodiment of the invention.

Referring to the fourth embodiment as shown in FIG. 8, certain ones 41 of emitters 4 re formed directly on a p-type semiconductor substrate 21, and the other ones 42 of emitters 4 are formed on a second emitter electrode 22, which is an n-type semiconductor layer formed overlying the semiconductor substrate 22. The insulating layer and the gate electrode 3 are formed in the same manner as in the first preferred embodiment. Between the semiconductor substrate 21 and the gate electrode 3 is connected with a pulse power source 8, and to the second emitter electrode 22 is connected either a DC electrode 23 or the semiconductor substrate 21 through a switch 7.

In the cold cathode illustrated in FIG. 8, if the switch 7 is set in the position I, a positive voltage against the semiconductor substrate 21 is applied to the second emitter electrode 22 from the DC power source 23. For this reason, even if a pulse is supplied from the pulse power source 8, there will occur no sufficient potential difference between the emitters 42 and the gate electrode 3, and accordingly no electrons will be emitted from the emitters 42. Therefore, as long as a pulse is supplied, electrons are emitted only from the emitters 41 to keep the current mode low. At this time, the junction formed between the second emitter electrode 22 and the semiconductor substrate 21 is biased in the inverse direction to keep fie second emitter electrode 22 in a separated state. If the switch is set in the position II, the output voltage of the pulse power source will be supplied between the emitters 4 and the gate electrode 3, and electrons will be emitted from all the emitters 4 (i.e., 41 and 42).

It is preferred that the second emitter electrode 22 be made of a metal having a work function of no less than 4 eV, such as platinum (Pt) or tungsten (W), and the impurity concentration of the p-type semiconductor substrate 21 be no more than $10^{18}/cm^3$, whereby a Schottky function will be formed between the second emitter electrode 22 and the p-type semiconductor substrate 21, enabling operation to take place in exactly the same manner. The output voltage of the DC power source 23 will be sufficient if it is greater than the difference between the output voltage Ep of the pulse power source 8 and the emitter-gate voltage Ee, at which the cold cathode begins to emit electrons. If the emitters 41 are also formed over the emitter electrode 22 which is an n-type semiconductor layer, and this electrode is kept at the same potential as the semiconductor substrate 21, exactly the same operation can be achieved.

in this fourth embodiment, the terminal I of the switch 7 may also be connected to the pulse power source 8 as shown in FIG. 5A, or the terminal I of the switch 7 in the first embodiment may also be connected to the DC power source 23 as in FIG. 8. Furthermore, the same operation can be achieved if an emitter electrode of a p-type semiconductor layer is formed over an n-type semiconductor substrate.

Figure 9:
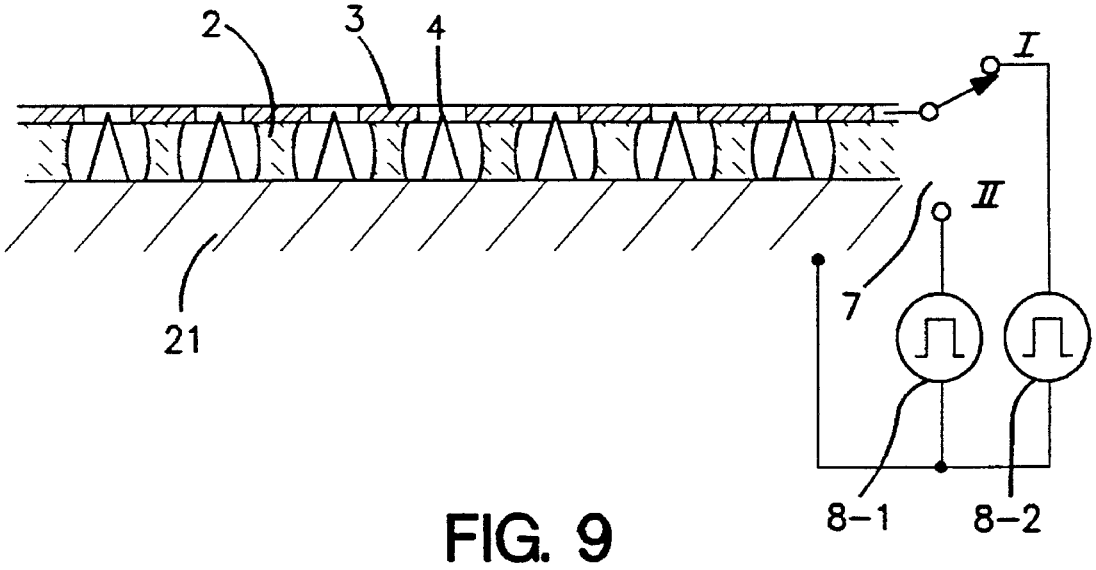
FIG. 9 shows a cross-sectional view of a cold cathode according to a fifth preferred embodiment of the invention.

In the first through fourth preferred embodiments, the same effect can be achieved by dividing the gate electrode 3 instead of the emitter electrodes or by dividing both the emitter electrodes and the gate electrode, In the fifth embodiment as shown in FIG. 9, emitters 4 on a substrate 21 are electrically connected to two pluse power sources 8-1 and 8-2. The pulse voltage fed to the gate electrode 3 on an insulating layer 2 can be varied by switching between the terminals I and II of the switch 7. Therefore, the pulsed current emitted from the cold cathode can be varied according to the position of the switch 7.

Figure 10:
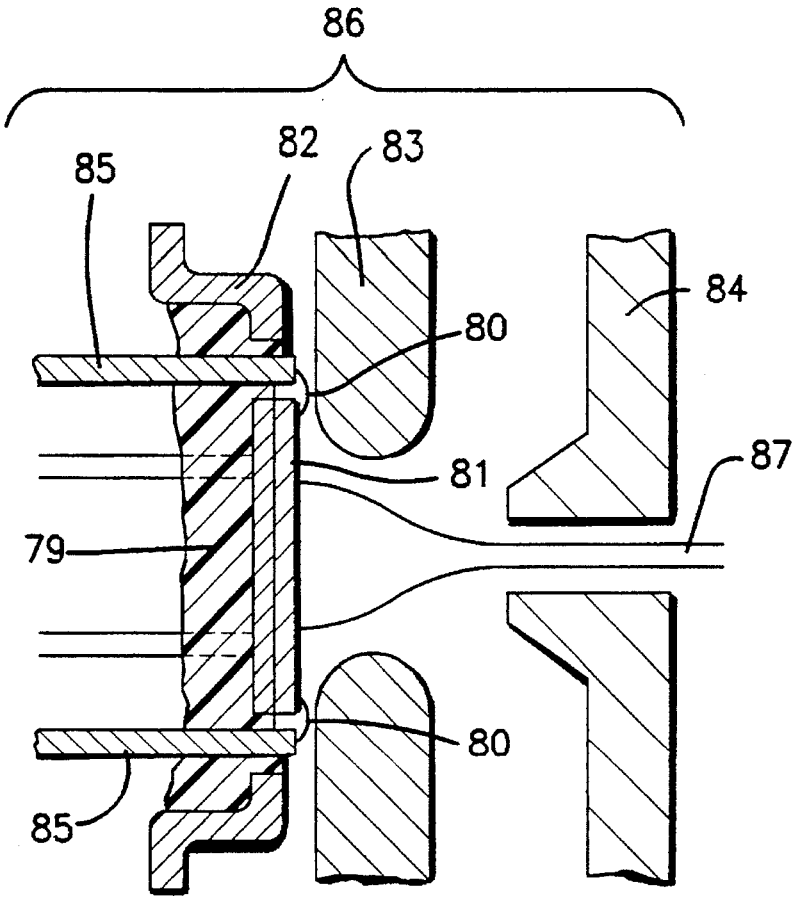
FIG. 10 is a cross-sectional view illustrating an example of packaging of a cold cathode according to the invention into an electron gun.

FIG. 10 illustrates an example of electron gun into which a cold cathode according to the invention is packaged. The electron gun 86 consists of a cold cathode 81, a cathode base 82, a focusing electrode 83, an anode 84 and a cathode conductor 85. The cold cathode 81 is mounted on the cathode base 82, having a similar structure to the metal package of a semiconductor, and the gate electrode 3 and the emitter electrodes 5, 6 of the cold cathode 81 are connected by a wire 80 to the cathode conductor 85 fixed to the cathode base 82 via an insulator 79 to be led to the outside of the vacuum outer holder. Electrons emitted from the emitters 4 of the cold cathode 81 are focused by an electrostatic field generated by the focusing electrode 83 and the anode 84, and formed into an electron beam 87.

Figure 11:
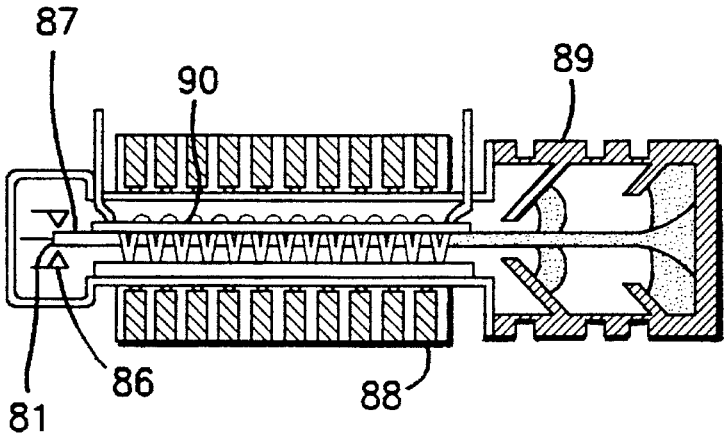
FIG. 11 is a cross-sectional view illustrating the structure of a microwave tube according to a sixth preferred embodiment of the invention.

FIG. 11 shows a cross-sectional view of a travelling-wave robe, which is a kind of microwave robe, a sixth preferred embodiment of the invention. In FIG. 11, electrons emitted from the cold cathode 81 are focused by an electrostatic field generated by the electron gun 86 and a magnetic field generated by a magnet 88 and formed into an electron beam 87. The electron beam 87 passes through the inside of a helix 90, which is a slow wave circuit of 1 mm or less in bore, and is caught by a collector 89. The input signal led into the helix 90 is amplified into an output signal by its interaction with electron beam 87 passing through the helix 90. In the high current mode an output signal of high power is obtained, while in the low current mode an output signal of low power is obtained.

Although the sixth embodiment illustrated in FIG. 11 uses helix as the slow wave circuit, not only a spiral but also a coupling cavity, a ring loop or tho like may be used. Furthermore, not only travelling-wave tube but also another type of microwave tube, such as a klystron or a gyrotron, may be applied to the cold cathode according to the present invention to utilize its advantages.

Moreover, the invention can also be effectively applied to a cold cathode having emitters formed by etching the substrate made of silicon or the like, instead of emitters formed by the stacking of a metallic material.

As hitherto described, the present invention makes it possible to realize for the first time many benefits which are impossible to realize by any known prior art. Thus, the cold cathode structure according to the invention enables the functions previously realized with a hot cathode and a plurality of grids to be achieved with a cathode of a planar structure, thereby dispensing with sophisticated assembling techniques, helps to reduce manhours spent on assembly, simplifies the structure and reduces the dimensions of electronic tubes.

Furthermore, since the focusing conditions of the electronic beam are brought far closer to the ideal than what the prior an permits, a high-quality, relatively ripple-free electronic beam can be realized, and a microwave tube using a cold cathode according to the invention can achieve nearly optimal operation whether in the high or in the low current mode.

I claim:

1. A field-emission cold cathode comprising:

an insulative substrate having a first portion and a second portion;

a first electrode disposed on said first portion;

a second electrode disposed on said second portion; and a plurality of electron-emitting electrodes, each having a pointed tip, disposed on said first electrode and second electrode, respectively;

said first electrode and said second electrode comprising interfitted comb-shaped arrays of parallel strip portions.

2. The field-emission cold cathode as claimed in claim 1, further comprising an insulating layer disposed on said substrate except in areas occupied by said plurality of electron-emitting electrodes.

3. The field-emission cold cathode as claimed in claim 2, further comprising a third electrode stacked on said insulating layer and having openings surrounding said plurality of electron-emitting electrodes.

4. The field-emission cold cathode as claimed in claim 3, further comprising a pulse power source connected between said first electrode and said third electrode for supplying a pulse between said first electrode and said third electrode.

5. The field-emission cold cathode as claimed in claim 4, further comprising a switching circuit connected to said first, second and third electrodes, said switching circuit connecting said first electrode to said second electrode for supplying said pulse between said first electrode and said second electrode when high current mode is demanded, and connecting said second electrode to said third electrode for supplying said pulse to said second electrode and said third electrode to keep at the same potential therebetween when low current mode is demanded.

6. A field-emission cold cathode comprising:

an insulative substrate having a first portion and a second portion;

a first electrode disposed on said first portion;

a second electrode disposed on said second portion; and a plurality of electron-emitting electrodes, each having a pointed tip, disposed on said first electrode and second electrode respectively;

said first electrode and said second electrode being coaxially arranged with respect to each other, said first electrode having a disc shape and said second electrode having an annular shape surrounding said first electrode.

7. The field-emission cold cathode as claimed in claim 6, further comprising an insulating layer disposed on said substrate except in areas occupied by said plurality of electron-emitting electrodes.

8. The field-emission cold cathode as claimed in claim 7, further comprising a third electrode stacked on said insulating layer and having openings surrounding said plurality of electron-emitting electrodes.

9. The field-emission cold cathode as claimed in claim 8, further comprising a pulse power source connected between said first electrode and said third electrode for supplying a pulse between said first electrode and said third electrode.

10. The field-emission cold cathode as claimed in claim 9, further comprising a switching circuit connected to said first, second and third electrodes, said switching circuit connecting said first electrode to said second electrode for supplying said pulse between said first electrode and said second electrode when high current mode is demanded, and connecting said second electrode to said third electrode for supplying said pulse to said second electrode and said third electrode when low current mode is demanded.

11. A field-emission cold cathode comprising:

a substrate of a first conductivity type having a first portion and a second portion;

a region of a second conductivity type opposite to said first conductivity type disposed on said first portion;

a first electron-emitting electrode disposed on said region; and a second electron-emitting electrode disposed on said substrate except at said region.

12. The field-emission cold cathode as claimed in claim 11, further comprising an insulating layer disposed on said substrate except in areas occupied by said first electron-emitting electrode and said second electron-emitting electrode.

13. The field-emission cold cathode as claimed in claim 12, further comprising an electrode stacked on said insulating layer and have openings surrounding said first electron-emitting electrode and said second electron-emitting electrode.

14. The field-emission cold cathode as claimed in claim 13, further comprising a pulse power source connected between said substrate and said electrode for supplying a pulse between said substrate and said electrode.

15. The field-emission cold cathode as claimed in claim 14, further comprising a biassing circuit connected to said region for decreasing potential difference between said first electron-emitting electrode and said electrode stacked on said insulating layer when low current mode is demanded.

* * * * *